US005692600A

United States Patent [19]

Bradshaw

[11] Patent Number: 5,692,600

[45] Date of Patent: Dec. 2, 1997

[54] ROTARY SWITCH FOR USE IN HYDRAULIC FLUID

[75] Inventor: Cyril Bradshaw, Wheaton, Ill.

[73] Assignee: Eaton Corporation, Cleveland, Ohio

[21] Appl. No.: 587,047

[22] Filed: Jan. 16, 1996

[51] Int. Cl.[6] ..... H01H 1/40

[52] U.S. Cl. ..... 200/571

[58] Field of Search ..... 200/571, 253, 200/252, 257, 260, 263, 302.3, 302.1, 336, 11 A

[56] References Cited

U.S. PATENT DOCUMENTS 3,024,338 3/1962 Nelson ..... 200/336 X
4,493,954 1/1985 Kimmel et al. ..... 200/11 A X
4,626,637 12/1986 Olsson et al. ..... 200/571 X
5,525,768 6/1996 Cobb, III et al. ..... 200/302.1 X

*Primary Examiner*—Renee S. Luebke
*Attorney, Agent, or Firm*—Roger A. Johnston

[57] ABSTRACT

A rotary position detector switch suitable for use in hydraulic fluid and having at least three stationary parallel conductive strips of tin plated low carbon steel intermittently over molded with intermediate portions exposed. An insulated rotor has a bus with spaced hardened steel pins with hemispherical ends slidably mounted thereon and bias springs connecting the pins to the bus. One stationary strip is completely exposed and is electrically common and in continuous contact with one pin. For each selected different rotor position combinations of two other pins contact different exposed portion of the remaining strips to give a discrete electrical indication, for each rotor position.

13 Claims, 3 Drawing Sheets

FIG. 2
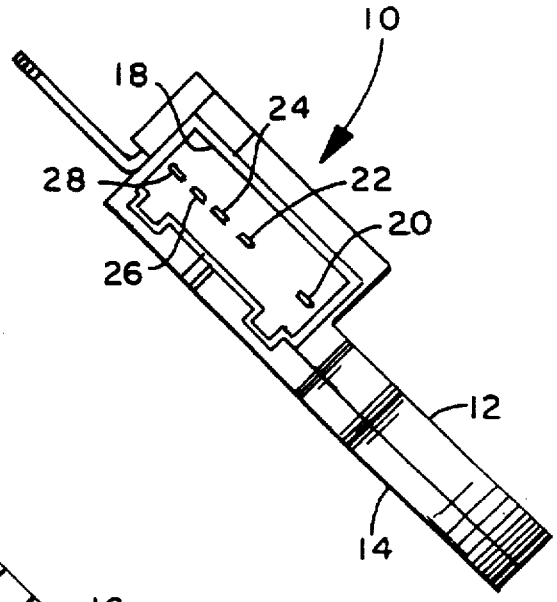
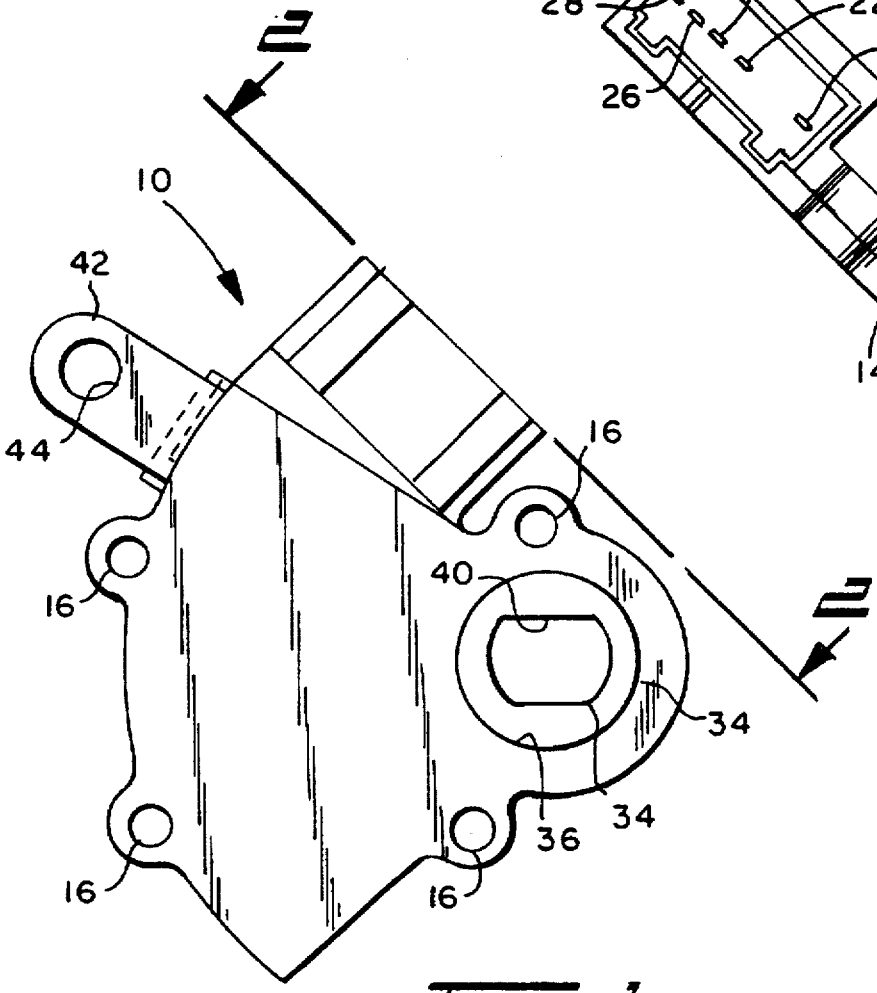
FIG. 1
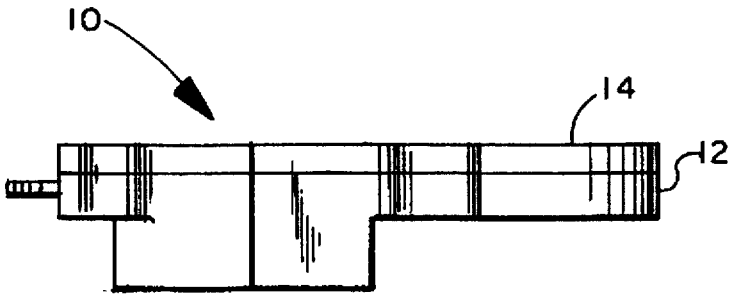
FIG. 3

ROTARY SWITCH FOR USE IN HYDRAULIC FLUID

BACKGROUND OF THE INVENTION

The present invention relates to electrical switches employed for providing an indication of the rotary position of a control mechanism and particularly where the control mechanism is immersed in fluid such as an hydraulic fluid. Such rotary position indicators are utilized in automotive power transmissions where it is necessary to provide an indication of the rotary position of the transmission mode selector shaft which is typically connected via a suitable linkage to a driver actuated selector for the desired mode of transmission operation. Heretofore, transmission selector shaft position indicators have been provided on the shaft linkage externally of the transmission; however, such arrangements have encountered problems in service due to the presence of road dirt and foreign matter and moisture interfering with the switch operation. Therefore, it has been desired to dispose the transmission mode selector shaft indicator switch internally within the transmission for protection. However, this imposes the requirement on the position indicator switch that it be able to function satisfactorily when drenched with or immersed in the transmission hydraulic fluid; and, this also has caused problems in service with respect to maintaining positive electrical contact of the switch members at all the desired positions.

An example of a known internally mounted transmission selector shaft position indicator switch is that shown and described in U.S. Pat. No. 5,099,092 issued to Richard L. Lauritsen and assigned to the assignee of the present invention. This known transmission selector shaft indicator switch utilizes a rotary disk having patterned conductive regions on the face thereof for completing a circuit through spring biased contact pins disposed in a predetermined pattern so as to provide a discrete electrical indication for each selected position of the selector shaft. The aforesaid known transmission selector position indicator switch utilized soft copper or silver conductive strips on a coded rotary disk and copper or silver plated pins for making contact with the coded strips. However, in service, problems have been encountered with the aforesaid known switch in providing sufficient wiping of the pins against the coded conductive strip in the presence of the transmission fluid for making effective electrical contact; and, the softness of the conductive material prohibited the utilization of heavy spring loads for the contact pins. Thus, it has been desired to provide a way or means of making a rotary position indicating switch for use in hydraulic fluids such as encountered inside an automotive transmission and provide for long contact life and positive electrical contact engagement and yet provide for relatively low manufacturing cost in high volume mass production.

SUMMARY OF THE INVENTION

The present invention provides an electrical switch for indicating the rotary position of a selector rotary mechanism or shaft and for providing a discrete electrical indication of the selected position. The present rotary position indicating switch is particularly suited for operation in the presence of hydraulic fluid and has found satisfactory application for indicating the position of a transmission mode selector shaft in an automotive power transmission.

In the aforesaid automotive transmission application, the rotary position indicator switch of the present invention provides reliable operation when exposed to the hydraulic fluid in the transmission and has a minimum manufacturing cost by virtue of eliminating the need for noble metal electrical contact materials. The rotary position indicator switch of the present invention utilizes at least three parallel stationary conductive strips on the base which are over-molded with plastic such that one strip is continuously exposed; and, the other strips have intermittent portions along the surface of a common side exposed. A plastic wiper is pivoted on the base or housing and has a bus bar attached thereto with a plurality of plungers slidably received in the wiper and electrically connected to the bus bar by compression springs which bias the plungers outwardly into contact with the strips on the base. The intermittently exposed strips are coated so as to produce a discreet electrical indication of each of the selected positions for the wiper. Low carbon steel is utilized for the conductive strips over-molded with plastic; and, the plungers are formed of hardened steel with hemispherical ends which provide a surface which under the spring bias wipes the stationary strips clean and ensures electrical contact with the exposed portions thereof. The bus bar of the present invention is snap locked onto the plastic wiper thus eliminating the need for an insert to be molded with the wiper thus reducing manufacturing costs. The stationary low carbon steel strips are tin plated to reduce the corrosive effects of the hydraulic fluid or moisture in the transmission.

BRIEF DESCRIPTION OF THE DRAWINGS

FIG. 1 is a plan view of the rotary position indicating switch of the present invention;

FIG. 2 is a view taken along section indicating lines 2—2 of FIG. 1;

FIG. 3 is a bottom view of the assembly of FIG. 1;

DETAILED DESCRIPTION

Figure 4:
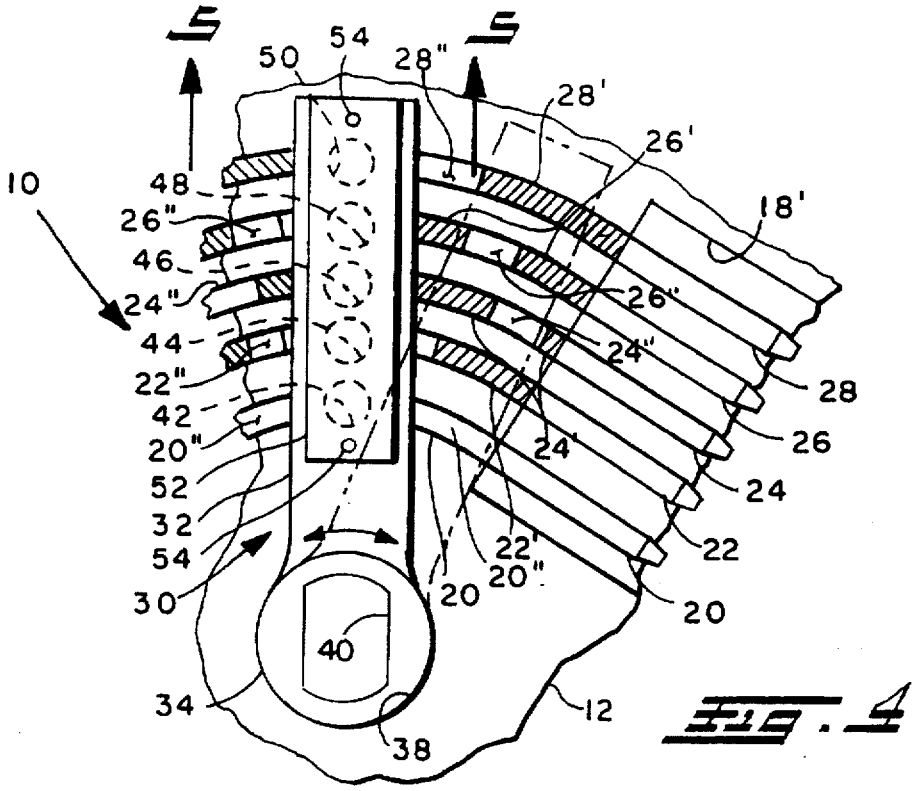
FIG. 4 is an enlarged portion of the device of FIG. 1 with the cover removed.

Referring to FIGS. 1–5, the rotary position indicating switch assembly of the present invention is indicated generally at 10 and has a lower housing shell portion 12 and an upper housing shell portion 14 or cover attached thereto by any suitable expedient such as rivets 16 or other fastening means as, for example, plastic weldment or heat staking. The housing shells 12, 14 define an electrical receptacle portion 18 which has extending therein electrical connector terminals 20, 22, 24, 26, 28 which are adapted for external electrical connection thereto as, for example, by a wiring harness connector socket (not shown).

Figure 5:
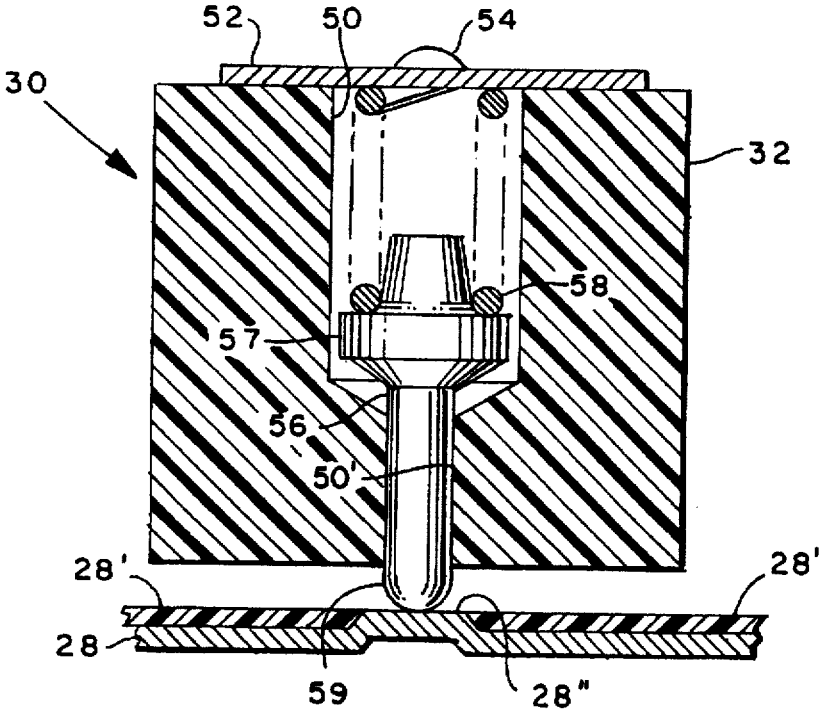
FIG. 5 is a section view taken along section indicating lines 5—5 of FIG. 4.

Referring to FIGS. 4 and 5, a wiper assembly indicated generally at 30 has a rotor member 32 preferably formed of molded plastic material disposed for pivotal movement on the housing shell 12 and 14 by journalling of a hub portion 34 formed on the end of the rotor 32 in apertures such as aperture 36 formed in the shell 14 (see FIG. 1) and aperture 38 formed in the shell 12 (see FIG. 4). Rotor hub 34 has an elongated slot 40 formed therein which is adapted for receiving a shaft (not shown) therethrough in driving engagement for effecting movement of the rotor 32.

Referring to FIG. 1, the housing shell portion 12 has provided thereon a mounting tab or lug 42 which has an aperture 44 formed therein for securing the assembly to the structure to be controlled in a manner preventing rotation of the housing.

It will be understood that when wiper assembly 30 is installed between the housing shelves 12 and 14, it is rotatable as, for example, between the positions shown in solid outlined and the position shown in dashed outline in FIG. 4.

The connector terminals 20, 22, 24, 26, 28 are disposed in the housing shell 12 as shown in FIG. 4 so as to extend therein in spaced arcuately parallel arrangement with intermittent spaced portions along certain of the strips exposed with the portions intermediate the exposed portions over-molded with the plastic material. The over-molded portions of the certain strips are shown cross hatched in FIG. 4 and are designated respectively with the reference numerals 22', 24', 26', 28'. The intermediate exposed portions 22", 24", 26", 28" are arcuately spaced to provide a coding to give discreet electric switching for each rotary position of the wiper assembly 30 as will hereinafter be described. It will be understood that surface 20" of strip 20 is exposed for the entire length of the strip; as, strip 20 is electrically common.

The rotor member 32 has formed therein a bore coincident with each of the strips 22–28; and the bores are illustrated in dashed outline in FIG. 4 denoted by reference numerals 42, 44, 46, 48, 50. The bores are open to the top of the rotor member 32 and have a reduced diameter portion extending to the lower surface of the rotor 32. A bus bar 52 is attached to the top of the rotor member 32 by any suitable expedient such as plastic riveting or melting as denoted by reference numeral 54. Bus bar 52 may be formed of any suitable electrically conductive material and extends over the open ends of each of the bores 42, 44, 48, 50.

Referring to FIG. 5, one of the bores 50 in the rotor member 32 is shown in an enlarged detail and has a reduced diameter portion 50' formed adjacent the lower surface of wiper member 32. A plunger or pin 56 is slidably received in the reduced diameter 50'; and, the pin has an enlarged diameter portion 57 disposed in the bore 50. A spring 58 is disposed in the bore 50 and has the upper end thereof in contact with the undersurface of bus bar 52 and the lower end in contact with the portion 57 of the pin 56 thus providing electrical contact between the bus bar and the pin 56. It will be understood that the arrangement of the pin 56 and spring 58 for the bore 50' is typical for each of the bores 42, 44, 46, 48, 50; and, a pin and spring is similarly disposed in each of the bores in the manner illustrated in FIG. 5 such that the lower end of the pin contacts respectively one of the strips 20, 22, 24, 26, 28 disposed in the lower housing 12.

In the presently preferred practice of the invention, the strips 20, 22, 24, 26, 28 are formed of low carbon steel and tin plated. Each of the pins such as pin 56 is formed of hardened steel and has a hemispherical configuration on the lower end thereof denoted by reference numeral 59 in FIG. 5. The surface pressure and stresses of contact of the end 59 of pin 56 with the exposed portions of strip 28 thus provide a wiping and self cleaning action between the contacts to provide good electrical conductivity in the presence of the hydraulic fluid. In the present practice of the invention, the five strips 20, 22, 24, 26, 28 have the exposed portions thereof 20", 22", 24", 26", 28" arranged so as to provide discreet electrical signal combinations for five different positions of the rotor member 32 as shown in Table I where in the positions P, R, N, D, L indicate different positions of the rotor member 32. It will be seen from Table I

TABLE I

| Rotor Position | | 28" | 26" | 24" | 22" | 20" |
|---|---|---|---|---|---|---|
| P | 0° | X | X | | | X |
| R | 20° | | X | X | | X |
| N | 40° | | | | | X |
| D | 60° | | | X | X | X |
| L | 80° | X | | X | | X |

that where strip 20 is common, by combinations of two other of the pins for the strips 22, 24, 26, 28 five different combinations of electrical signal may be generated to give a discreet indication of each rotor position. With reference to Table 1, it will be understood that electrical power enters through the common strip 20 and flows through the bus 52 to the two strips identified by the X's in Table 1 for the indicated rotor position. In the present practice of the invention, the rotor element is moved through a central arc of about 20° for each discreet position; and, the rotor 32 has a length of about 30 millimeters. It will be understood that for an automotive transmission mode selector indicator application of the prsent invention, the positions indicated in Table 1 represent positions for Park, Reverse, Neutral, Drive and Low modes of transmission function; and, the signals generated on the two strips for each selected position of the rotor 32 may be utilzied to provide separate signals to the transmission controller and the driver indicator light for the selected transmission mode.

Figure 6:
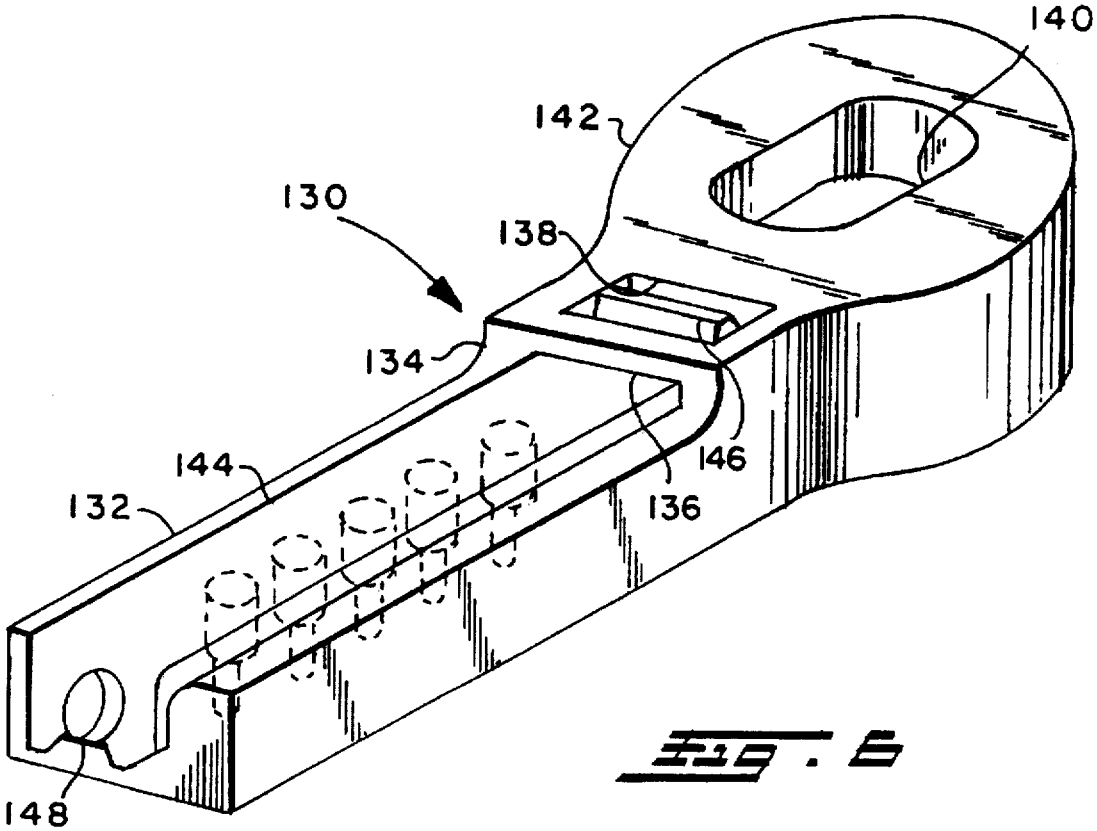
FIG. 6 is an axonometric view of the wiper of the device of FIG. 1.

Referring to FIG. 6, another embodiment of the wiper assembly is indicated at generally at 130 and includes a rotor element 132 having a slot 140 formed therein for driving engagmenet with a shaft (not shown). The rotor 132 of the FIG. 6 embodiment has a shoulder 134 formed theron defining the upper surface; and, a slot 136 is formed in the shoulder which intersects a mortise or recess 138 formed in the upper surface of the hub 142 of the rotor. A bus bar 144 has one end thereof configured to a generally right angle flange 146 which is received in and hooked into the slot 136 and extends into the mortise 138 for retaining the end of the bus bar. The opposite end of the bus bar is snap locked over a projection or lug 148 provided on the end of the rotor 132. The arrangment of the rotor of FIG. 6 thus eliminates the need for heat staking or riveting the bus bar onto the rotor.

The present invention thus provides a unique and novel rotary position detector switch suitable for operation in hydrualic fluid environment and which is reliable and relatively low in manufacturing cost. The switch employs tin plated low carbon steel terminal strips over molded intermediatently therealong to provide portions of the strips exposed for wiper contact. The switch rotor contains spring loaded hardened steel pins with hemispherical ends which wipe of the stationary exposed portions of the stationary contact strips to give discreet electrical indication of each selected rotor position.

Although the present invention has been described hereinabove with respect to the illustrated embodiments, it will be understood that the invention is capable of modification and variation and is limited only by the scope of the following claims.

We claim:

1. A rotary switching assembly for operating in hydraulic fluid comprising:

(a) housing means formed of electrical insulating material and having a plurality of continuous conductive strips disposed thereon in generally spaced parallel arrangement with at least one of said strips continuously exposed there along and with at least one other of said strips having intermittent first portions there along covered with said insulting material and second portions exposed intermediate said covered portions;

(b) a wiper member disposed on said housing for movement about a pivot on said housing means, said wiper including means for shorting operative to continuously wipe under a bias force said one continuously exposed strip and to provide an electrical path between said continuously exposed strip and the exposed portions of said at least one other strip when said wiper is moved through said movement about said pivot.

2. The assembly defined in claim 1, wherein said strips each have an arcuate configuration.

3. The assembly defined in claim 1, wherein each of said strips has an end thereof formed into a connector terminal extending exteriorly of said housing means.

4. The assembly defined in claim 1, wherein said strips have an arcuate configuration and are disposed in generally concentric arrangement.

5. The assembly defined in claim 1, wherein said means for shorting includes a bus bar and at least two pins, each spring-biased from said wiper to one of said strips, said pins each electrically connected to said bus bar.

6. The assembly defined in claim 1, wherein said strips are formed of tin plated steel.

7. The assembly defined in claim 1, wherein said means for shorting includes a bus bar; at least two hardened steel pins slidably received in said wiper member; and spring means biasing each of said pins into contact with one of said strips.

8. The assembly defined in claim 1, wherein said intermittent portions of said strip are covered with plastic material.

9. The assembly defined in claim 1, wherein said wiper member is formed of plastic material.

10. The assembly defined in claim 1, wherein said continuous conductive strips are formed of tin plated steel.

11. The assembly defined in claim 1, wherein said shorting means includes a plurality of hardened steel pins.

12. The assembly defined in claim 1, wherein said shorting means includes a plurality of hardened steel pins each having a hemispherical surface on an end thereof contacting said strips.

13. The assembly defined in claim 1, wherein said strips are formed of tin (Sn) plated steel and said shorting means includes a plurality of pins slidably mounted on said wiper member, said pins formed of steel having a hardness significantly greater than said strips.

* * * * *